United States Patent [19]

Reif et al.

[11] 4,342,641

[45] Aug. 3, 1982

[54] MAXIMIZING JET FUEL FROM SHALE OIL

[75] Inventors: Henry E. Reif, Bryn Mawr, Pa.; Peter Maruhnic; Michael C. Chervenak, both of Pennington, N.J.

[73] Assignees: Sun Tech, Inc., Philadelphia, Pa.; Hydrocarbon Research, Inc., Lawrenceville, N.J.

[21] Appl. No.: 208,094

[22] Filed: Nov. 18, 1980

[51] Int. Cl.[3] ..... C10G 45/08; C10G 45/60

[52] U.S. Cl. ..... 208/89; 208/57; 208/143; 208/210; 208/211; 208/59

[58] Field of Search ..... 208/89, 211, 57, 59, 208/143

[56] References Cited

U.S. PATENT DOCUMENTS

| | | | |
|---|---|---|---|
| 3,092,567 | 6/1963 | Kozlowski et al. | 208/89 |
| 3,175,970 | 3/1965 | Bercik et al. | 208/89 |
| 3,236,764 | 2/1966 | Den Herder et al. | 208/89 |
| 3,369,998 | 2/1968 | Bercik et al. | 208/210 |
| 3,546,103 | 12/1970 | Hamner et al. | 208/211 |
| 3,594,307 | 7/1971 | Kirk, Jr. | 208/89 |
| 3,717,571 | 2/1973 | Schulman | 208/210 |
| 3,779,903 | 12/1973 | Levinson | 208/254 H |
| 3,850,746 | 11/1974 | Robson | 208/254 H |
| 3,860,510 | 1/1975 | Henke et al. | 208/89 |
| 3,954,603 | 5/1976 | Curtin | 208/253 |
| 4,022,682 | 5/1977 | Bludis et al. | 208/89 |
| 4,133,745 | 1/1979 | Wunderlich | 208/254 H |

*Primary Examiner*—Delbert E. Gantz
*Assistant Examiner*—O. Chaudhuri
*Attorney, Agent, or Firm*—J. Edward Hess; Donald R. Johnson; Patrick C. Baker

[57] ABSTRACT

Improved method for maximizing jet fuel from shale oil involves hydrotreating the treated oil at a temperature of about 600°–650° F. in the presence of a catalyst having a relatively low metal content and then hydrotreating the oil at a temperature in excess of about 800° F. in the presence of a catalyst having a relatively high metal content. A 480° F. minus boiling point fraction fractionated from the foregoing process can meet JP-4 jet fuel specifications. Hydrocracking the 480° F. plus boiling point fraction results in substantial additional quantities of jet fuel.

5 Claims, 1 Drawing Figure

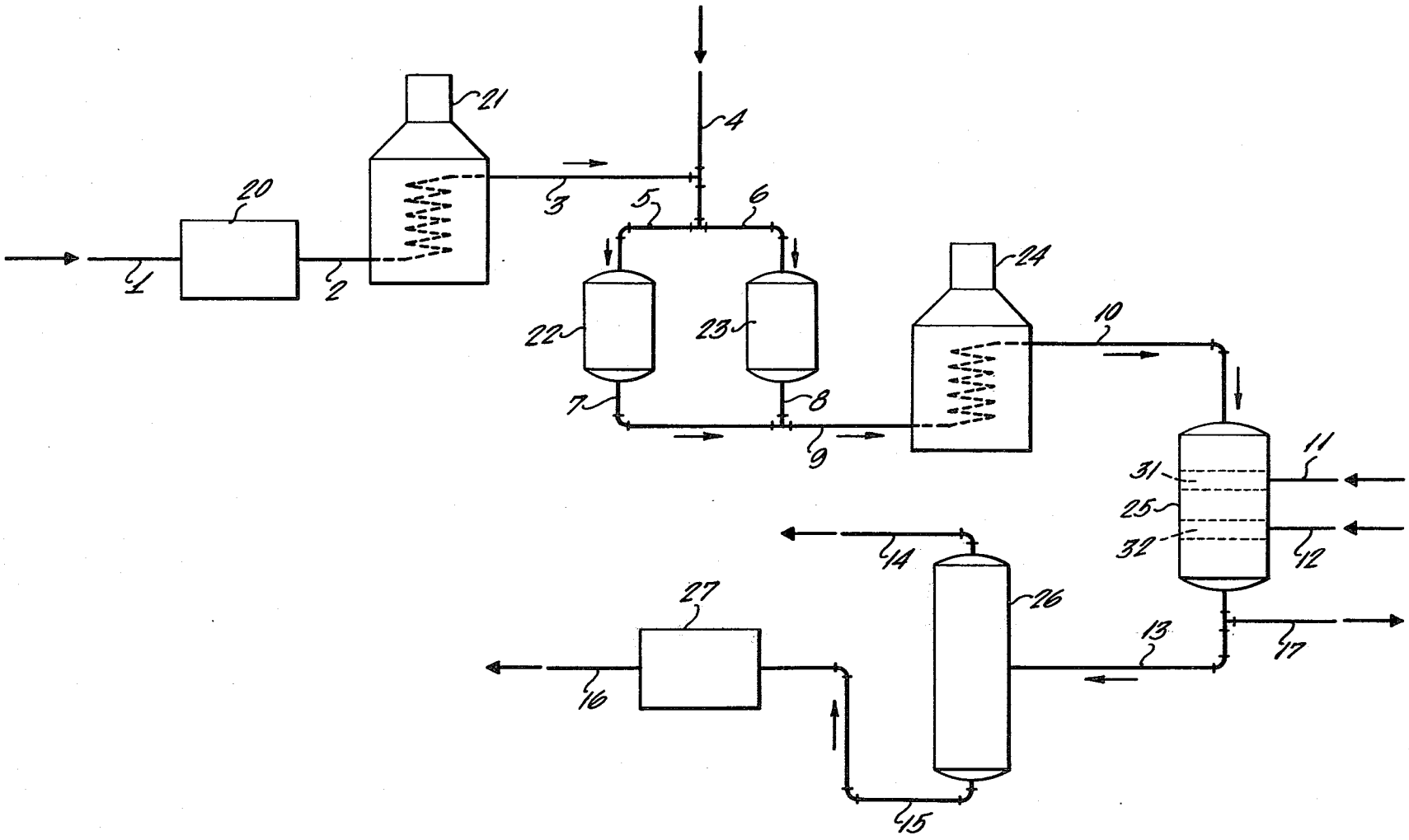
1
2
3
4
5
6
7
8
9
10
11
12
13
14
15
16
17
20
21
22
23
24
25
26
27
31
32

MAXIMIZING JET FUEL FROM SHALE OIL

The United States Government has rights in this invention pursuant to Contract F33615-78-C-2024 awarded by the Department of the Air Force.

BACKGROUND OF THE INVENTION

1. Field of the Invention

This invention relates to a method of hydrotreating shale oil. More particularly it relates to the catalytic treatment of crude shale oil with hydrogen under specified conditions whereby the amount of jet fuel produced per barrel of shale oil is substantially greater than by conventional methods.

2. Description of the Prior Art

Crude shale oil contains nitrogen containing compounds and impurities such as arsenic, compounds of arsenic, iron and compounds of iron. Both the nitrogen compounds and impurities are desirably removed or at least minimized in the final shale oil product. While sulfur and oxygen containing compounds are also present, treatment of the oil by hydrogen will reduce the amount present in the oil.

Crude shale oil produced by thermal means also contains organic compounds having unsaturated hydrocarbon bonds such as olefinic and diolefinic bonds. The unsaturation is undesirable because of possible problems it can cause in processing and in the final shale oil product.

Shale oil is obtained from oil shale which is indigenous in large quantities within the continental United States. Its availability can insure that the United States armed forces have sufficient hydrocarbon fuel, particularly, jet fuel, e.g., JP-4, for its national defense.

Thus it is imperative that crude shale oil be easily and relatively inexpensively processed whereby the nitrogen compounds and impurities are removed, the unsaturated carbon bonds saturated, and a large percent of the crude shale oil converted to jet fuel.

U.S. Pat. No. 3,779,903, G. S., Levinson, Dec. 18, 1973 discloses a catalytic hydrodenitrification of shale oil at a temperature of 250°–480° C. (482° F.–896° F.), 100–5000 psig, LHSV (volume of feed/volume of catalyst/hour) 0.1–10 and $H_2$/oil, SCF/BBL of 200–15,000. The catalyst contains oxides of nickel, molybdenum, tungsten, cobalt and mixtures thereof. U.S. Pat. No. 3,850,746, H. E. Robson, Nov. 26, 1974 discloses catalytic hydrodenitrification of hydrocarbon feedstocks at pressures ranging from about 500 psi to about 2000 psi, hydrogen gas rates ranging from about 1000 SCF/BBL to about 10,000 SCF/BBL and a superficial liquid hourly space velocity, LHSV, ranging from about 1 to about 5 with temperatures generally ranging from about 350° C. (662° F.) to about 390° C. (734° F.) at start-of-run conditions and from about 390° C. to about 430° C. (806° F.) at end-of-run conditions. The catalyst is a chrysotile catalyst combined with a hydrogenation component selected from Group VIB, Group VIIB and Group VIII metals; representatives of these metals include nickel and molybdenum. U.S. Pat. No. 3,717,571, B. L. Schulman, Feb. 20, 1973 discloses two stage hydrogenation for raw shale oil. The operating conditions for the stages are as follows:

| | First Stage | Second Stage |
|---|---|---|
| Temperature °F. | 650 to 800 | 600 to 750 |

-continued

| | First Stage | Second Stage |
|---|---|---|
| Pressure, psig | 1000 to 4000 | 1000 to 4000 |
| LHSV, w/hr/w | 0.1 to 3.0 | 0.1 to 3.0 |
| $H_2$ treat rate, SCF/BBL | 5000 to 30,000 | 5000 to 30,000 |
| Catalyst, e.g., | CoMo on $Al_2O_3$ | CoMo on $Al_2O_3$ |

U.S. Pat. No. 4,133,745, D. K. Wunderlich, Jan. 9, 1979 discloses fractioning raw shale oil into a naphtha cut and a gas oil cut. The naphtha cut (350° F., end point), along with a second naphtha cut (450° F., end point) obtained from hydrotreating the gas oil cut, is midly hydrotreated (compared to the gas oil cut). The gas oil cut is first subjected to an impurity removal step prior to its severe hydrotreatment (compared to the naphtha) at 750° F., 2000 psig and whsv of 2.4, for example. The impurity removal step can consist of treatment with a calalyst designed for the removal of such impurities on the catalyst, caustic treating, and so forth as is known in the art, as disclosed more particularly in U.S. Pat. No. 3,954,603, D. J. Curtin, May 4, 1976.

However, none ot the prior art suggests applicants' particular operating conditions whereby the result is the making of a relatively large amount of jet fuel from crude shale oil.

SUMMARY OF THE INVENTION

The present invention maximizes the amount of jet fuel that can be produced from a barrel of crude shale oil feed. The invention involves contacting the shale oil at a relatively low temperature (e.g., 600°–650° F.) with hydrogen in the presence of a hydrogenation catalyst having a relatively low metals content; the LSHV (feed/hour/volume of catalyst) in this step is in excess of about one. This step saturates existing olefinic and diolefinic hydrocarbon bonds and removes nearly all of the metallic components along with minor amounts of nitrogen and sulfur. Then the treated shale oil is contacted at a relatively high temperature (e.g., in excess of about 800° F.) with hydrogen in the presence of a hydrogenation catalyst having a relatively high metals content. The product from the second hydrogen treating step can be fractionated into a IBP-480° F. fraction (IBP refers to initial boiling point) which can be used as a JP-4 jet fuel since its properties meet the specifications of such a jet fuel. The 480° F. plus boiling fraction can be hydrocracked into more jet fuel. The overall result of the foregoing process is that more than one barrel of JP-4 jet fuel can be made from one barrel of crude shale oil.

BRIEF DESCRIPTION OF THE DRAWING

The accompanying drawing shows one process embodying the invention of applicants' process.

DETAILED DESCRIPTION

More specifically, the drawing shows crude shale oil feed from a retort or other shale oil generation source in line 1 passing to means 20 for removing iron particles from the oil. Means 20 can be, for example, a filter. Satisfactory results have been obtained using a 5 micron filter or a 1 micron filter. Removal of the particles can reduce the coking that otherwise would occur in the pipes (or heating coil) of heater 21 and thereby materially increasing its on stream time. The crude shale oil feed generally contains nitrogen compounds and impurities which may vary widely, but generally will be based on the total weight of crude shale oil feed, at least 1.4 wt. % nitrogen and at least 100 ppm (parts per million) impurities (metals) including about 20–50 ppm arsenic.

After most, if not essentially all, of the iron particles have been removed from the oil by means 20 the oil proceeds via line 2 to the aforementioned heater 21. In heater 21 the temperature of the oil is increased to an elevated temperature up to about preferably 590°–610° F. and this is the inlet temperature to units 22 and/or 23. This temperature can vary more than the previously mentioned range, however, it should be sufficiently high to facilitate the hydrogenation but not so high as to cause an undesirable amount of coking. The heated oil leaves heater 21 via line 3 and via lines 5 and/or 6 proceeds to units 22 and/or 23. Hydrogen is incorporated in the oil via line 4. The amount of hydrogen is sufficient to give a hydrogen partial pressure of about preferably 2400–2800 psi, however, it can vary more than the previously mentioned range. The gas recycle rate (hydrogen plus other materials such as methane) is about 200–10,000 SCF/BBL of feed.

The reaction within units 22 and 23 is exothermic and thus the temperature of the oil leaving is higher, e.g., 650° F. Thus when the inlet temperature is 600° F. and the outlet temperature is about 650° F. the average temperature is 625° F. Generally the outlet temperature will not exceed about 650° F., however, towards the end of the run it could be at about 675° F. Units 22 and 23 contain a hydrogenation catalyst, e.g., Ni-Mo, Ni-W or Co-Mo on alumina, with a Ni-Mo on ⅛" alumina spheres preferred. Other useable catalysts include the metals of Group VI and VIII of the Periodic Table supported on a suitable porous support material such as alumina, silica, bauxite, magnesia and the like. Oxide catalysts are preferably sulfided prior to use or in situ. The nickel content desirably ranges between from about 1 wt. % to about 3 wt. % while the molybdenum ranges between from about 2 wt. % to about 10 wt. %. The previously mentioned values would characterize the hydrogenation catalyst as having a relatively low metals content, however, the amount could be different than that mentioned. Another way of characterizing the catalyst would be referred to as a relatively mildly active catalyst. Spheres are preferred since they give more open space than particles and thereby reduce the possibility of plugging the bed. In units 22 and 23 unsaturated hydrocarbon bonds are saturated with hydrogen, some of the nitrogen compounds are converted to ammonia, and essentially all of the iron and arsenic compounds are converted to metals and metal sulfides and deposited on the catalyst. Units 22 and 23 can be operated in parallel or alternately. The latter indicates that while one unit is used to treat the oil the other itself is processed to remove any impurities which are adversely affecting the hydrogenation of the oil feed. More than two units can be used and can be arranged in various configurations. The oil leaving units 22 and/or 23, after contacting a relatively mild hydrogenation catalyst, generally contain about 1.2 to 1.7 wt. % nitrogen and about 1 to 6 ppm of arsenic impurities. The LHSV within unit 22 and/or 23 will generally be at least about 1, and preferably 2–10; however, values as high as 30 would be tolerable.

The treated oil leaves units 22 and/or 23 via lines 7 and 8 which feeds into line 9. Line 9 carries the treated oil to heater 24 wherein the temperature of the oil is increased to preferably about 700°–725° F. The heated oil leaves heater 24 via line 10 and proceeds to unit 25 which can be, for example, a fixed bed containing a highly active (compared to the catalyst in units 22 and 23) hydrogenation catalyst such as Ni-Mo, Ni-W or Co-Mo or alumina. The nickel content of the relatively highly active catalyst desirably ranges between from about 1.5 to 5 wt. % while the molybdenum ranges between from about 8 to about 15 wt. %. These values do overlap the values given for the midly active catalyst because the method involves the use of relative amounts of metal on the catalyst rather than absolute values. Also the catalyst size in this second stage is somewhat smaller compared to the first stage, e.g., a 1/16" extrudate. Unit 25 is designed, in this embodiment, so that spaced throughout the unit are separate quench zones, 31 and 32. These zones permit control of the temperature within unit 25 and when the zones are hydrogen quench zones, additional hydrogen is added via lines 11 and 12 to the incoming heated oil. The reaction within unit 25 is exothermic so that the oil leaving unit 25 is at a temperature of about 825°–835° F. or higher. However, the inlet temperature of the oil to the first section is about 700° F. whereas the temperature of the oil entering the first quench zone is about 790° F. For the next section, the comparative temperatures are 725°–825° F. and for the third section the temperatures are 750°–835° F. Thus, the catalyst contained in the lower portion of unit 25 is at an elevated temperature of 825°–835° F. and the oil contacts the catalyst at a temperature in excess of about 800° F. And this higher temperature is necessary to cause the front end of the oil to have a distillation which meets the requirements of the specifications for JP-4 jet fuel. Further, it is surprising that this higher temperature does not tend to deactivate the catalyst. The LHSV within unit 25 is generally in the range of about 0.75 to 1.25. The treated oil leaving unit 25 via line 13 contains about $<1$ to 100 ppm of nitrogen. The hydrogen consumption within units 22 and/or 23 and 25 can vary, depending on the particular oil, however, in one run it amounted to about 1600 SCF/BBL of feed. As indicated the partial pressure of the hydrogen within unit 25 is about 2400–2800 psi while the total pressure is in the range of about 2600–3000 psig. Any hydrogen not consumed within the system is separarted from the oil and the light hydrocarbons, ammonia and hydrogen sulfide removed by known means (not shown) and recycled for example by line 17 which can feed line 4. Generally the amount of hydrogen recycled within the system is about 4000–8000 SCF/BBL of feed.

In the second hydrotreating stage the nitrogen, sulfur, and oxygen compounds and any remaining metallic ones are converted to removable forms. Also the aromatics are saturated and alkyl aromatics are dealkylated.

After the treated oil leaves unit 25 and unused hydrogen and other gases are separated and removed by various means (not shown) it can be fed to unit 26 via line 13. Unit 26 can be a fractionator wherein the oil is fractionated into at least a 480° F. minus fraction and a 480° F. plus fraction. (as used herein 480° F. minus fraction means that the vapor temperature of the overhead fraction from the still is no more than 480° F. whereas a 480° F. plus fraction means the oil has an initial boiling point of about 480° F.). The 480° F. minus fraction, which leaves as an overhead stream via line 14, is surprisingly a product which can be used as jet fuel. As discussed in the Examples this fraction can be used essentially as is without further processing. The 480° F. plus bottom leaving unit 26 via line 15 is a waxy material containing about, for example, 5–150 ppm of nitrogen. The material in line 15 can be fed to unit 27, for example, a hydrocracker. In the hydrocracker the 480° F. plus oil is converted to a lighter boiling material while the nitrogen level is reduced substantially. The product leaving unit 27 via line 16 can be a jet fuel product after some separation. As a result of the combination of the hydrogenation steps in units 22 and/or 23 and 25 and the hydrocracking of unit 27 the overall yield of jet fuel is surprisingly more than on bbl per bbl of crude shale oil. Unit 27 as an alternative can be a fluid catalytic cracker.

Operating conditions for the hydrocracker can vary but generally will be as follows: temperature 725° to 800° F.; pressure 1500 to 2500 psig, hydrogen consumption 1200 to 2100 SCF/BBL. The different useable catalysts are well known and include Ni-W or Ni-Mo on a suitable support.

The following examples and a comparative run illustrates the results which can be obtained by using applicants' method.

EXAMPLE

Crude shale oil having the following properties:

| | Distillation, °F. | |
|---|---|---|
| °API @ 50° F.-26.8 | | |
| Sulfur, wt. %-0.48 | IBP | 345 |
| Nitrogen, total wt. %-1.66 | 5 vol. % | 437 |
| Carbon, wt. %-84.48 | 50 | 655 |
| Hydrogen, wt. %-11.69 | 90 | 880 |
| Oxygen, wt. %-1.75 | EP | 975 (95.5) |
| Iron ppm-60 | | |
| Arsenic ppm-20 | | |
| Ash, wt. % (650° F.+)-0.063 | | |

was filtered through a 1 micron filter thereby reducing the iron and arsenic substantially. The filtered raw shale oil was fed to the first stage hydrotreating unit operating under the following conditions:

| | |
|---|---|
| Temperature (Avg) | 625° F. |
| LHSV, V/hr/V | 1.0 |
| Pressure, total psig | 2800 |
| H2 partial pressure, psia | 2600 |
| Recycle Gas, SCF/B feed | 6000 |

The foregoing temperature is an average temperature, that is the sum of temperature of the oil entering the reactor plus the temperature of the oil leaving the reactor divided by two. The reactor unit was a down flow unit and the catalyst was a commercially available Ni-Mo on ⅛" alumina spheres (1.8 wt. % Ni and 5.4 wt. % Mo). The product had the following properties: 30° API gravity ⅝ 60° F., 1.39 wt. % nitrogen, 0.35 wt. % sulfur and 1 ppm arsenic.

The liquid product from the down flow unit was fed to the second stage hydrotreating unit operating under the following conditions:

| | |
|---|---|
| Temperature °F. (Avg) | 825 |
| LHSV, V/hr/V | 1.0 |
| Pressure, total psig | 2800 |
| H2 partial pressure | 2600 |
| Recycle Gas, SCF/BBL Feed | 6000 |
| $H_2$ Consumption, SCF/BBL Feed | 1600 |

The reactor unit was a down flow unit and the catalyst was a commercially available 1/16" extrudate NiMo on alumina (2.7 wt. % Ni, 13.2 wt. % Mo). While both stages had the same metals as catalysts, different catalysts having different metals are equally usable.

The whole liquid product had the following properties: 42.0 API Gravity @ 60° F.; sulfur, ppm 100; total nitrogen, ppm <1; volume of initial boiling point (IBP) to 480° F.−, 39%; 480° F.+ bottoms, 61 vol. %.

The properties of the IBP-480° F. product, along with the specifications for JP-4 jet fuel, were as follows:

| | Product | Specification |
|---|---|---|
| °API gravity, @ 60° F. | 49.0 | 45–57 |
| Aniline Point, °F. | 139.2 | n.a. |
| Freeze Point, °F. | −75 | −72 max. |
| Aromatics, Vol. % | 8.6 | 25 max. |
| Olefins, Vol. % | 0.4 | 5 max. |
| Sulfur | 6 ppm | 0.4 wt. % max. |
| Total Nitrogen | <1, ppm | n.a. |
| Thermal Stability, P | 0 | 25 mm max. |
| Deposit (Code) | 0 | 3 max. |
| Copper Strip, Corrosion | 1a | 1b max. |
| Distillation, Temp. °F. | | |
| 20 vol. % | 293 | 293 max. |
| 50 vol. % | 374 | 374 max. |
| 90 vol. % | 448 | 473 max. |
| EP vol. % | 509 | 518 max. |

n.a. = not applicable

Comparison of the properties of product with the JP-4 specifications indicate that the product meets specifications and is an acceptable jet fuel.

The 480° F.+ bottoms had the following properties: 37.4 API gravity @ 60° F.; aromatics, wt. % 18.4; sulfur, ppm. 156; and total nitrogen, ppm <1.

Another example of applicants' method was made with a reactor temperature of 850° F. The jet fuel distilled from the high temperature run also met JP-4 specifications.

A comparative run was made wherein the operating conditions of the second reactor were as follows:

| | |
|---|---|
| Temperature °F. (Avg) | 780 |
| LHSV, V/hr/V | 1.0 |
| $H_2$, partial pressure | 2000 |
| Recycle Gas, SCF/BBL Feed | 4000 |

However, the jet fuel distilled from the product could not meet the front end distillation specifications for JP-4, i.e. 20 and 50 vol. % temperatures. The whole liquid product from this comparative run had the following properties: 37.2 API gravity @ 60° F.; 13 vol. % at 400° F. and 48 vol. % at 550° F.; sulfur 0.12 wt. %; nitrogen 0.045 wt. %; arsenic <0.1 ppm, and oxygen 0.33 wt. %.

The foregoing description of a preferred mode of performing the invention will suggest various changes and modifications of the process obvious to those skilled in the art which are nevertheless within the spirit and scope of the invention as defined by the following claims.

We claim:

1. In the process of hydrotreating crude shale oil the improvement which comprises:

(a) contacting crude shale oil at a temperature of up to about 650° F. with hydrogen and a hydrogenation catalyst comprising about 1–3 wt. % nickel and about 2–10 wt. % molybdenum; and (b) contacting the treated oil of step (a) at a temperature in excess of about 800° F. with hydrogen and a hydrogenation catalyst having a higher metal content than the catalyst of step (a), said higher metal content catalyst comprising about 1.5–5 wt. % nickel and about 8–15 wt. % molybdenum;

whereby steps (a) and (b) produce, after fractionation, a jet fuel meeting JP-4 specifications.

2. A process according to claim 1 wherein after fractionating out a jet fuel the remaining oil is hydrocracked whereby the total amount of jet fuel produced per barrel of crude shale oil is in excess of 100 volume %.

3. A process according to claim 1 wherein the contacting temperature of step (b) is about at least 825° F.

4. A process according to claim 1 wherein the hydrogenation catalysts are supported on porous supports.

5. A process according to claim 4 wherein the supports comprise alumina.

* * * * *